US007439672B2

(12) United States Patent
Enz

(10) Patent No.: US 7,439,672 B2
(45) Date of Patent: Oct. 21, 2008

(54) THREE-DIMENSIONAL ELECTROLUMINESCENCE DISPLAY

(75) Inventor: Emil Enz, Gais (CH)

(73) Assignee: Lyttron Technology GmgH, Cologne (DE)

( * ) Notice: Subject to any disclaimer, the term of this patent is extended or adjusted under 35 U.S.C. 154(b) by 122 days.

(21) Appl. No.: 10/493,578

(22) PCT Filed: Oct. 24, 2002

(86) PCT No.: PCT/CH02/00579

§ 371 (c)(1),
(2), (4) Date: Oct. 13, 2004

(87) PCT Pub. No.: WO03/037039

PCT Pub. Date: May 1, 2003

(65) Prior Publication Data

US 2005/0040769 A1 Feb. 24, 2005

(51) Int. Cl.
*H01J 1/62* (2006.01)
*H01J 63/04* (2006.01)

(52) U.S. Cl. ..... 313/506; 313/498; 313/510; 313/512; 445/24

(58) Field of Classification Search ..... 313/498, 313/502, 504, 510–512, 506; 315/169.3; 445/24, 25

See application file for complete search history.

(56) References Cited

U.S. PATENT DOCUMENTS 5,780,965 A 7/1998 Paciorek et al.
5,856,030 A 1/1999 Burrows
6,229,517 B1 * 5/2001 Enz ..... 345/108
6,465,951 B1 10/2002 Paciorek et al

* cited by examiner

*Primary Examiner*—Toan Ton
*Assistant Examiner*—Kevin Quarterman
(74) *Attorney, Agent, or Firm*—Browdy and Neimark, P.L.L.C.

(57) ABSTRACT

The three-dimensional electroluminescence display comprises a main body (1) and an electroluminescence device (20). Said electroluminescence device (20) comprises a film (2) and an electroluminescent arrangement (10) which together form a whole. The surface of the film (2), facing the electroluminescent arrangement (10) is provided with the motifs (9) for display. The electroluminescent arrangement (10) comprises a front electrode (11) and a back electrode (12), between which a dielectric (13) is located. The front electrode (11) is provided with the layer which produces the motif (9) and is embodied in one piece with the same. A supply source (15) is arranged within the surface of the electroluminescence device (20), which contacts the electrodes (11,12) of the electroluminescence device (20).

11 Claims, 8 Drawing Sheets

20
102
201
101
29
6
5
3
20
4
1
105
106
103
15
17
18
7

8
107
101
VOLUME

THREE-DIMENSIONAL ELECTROLUMINESCENCE DISPLAY

The present invention relates to a three-dimensional electroluminescent display having a transparent front part and having an electroluminescent apparatus arranged behind said front part.

A three-dimensional electroluminescent display of this generic type is already known. This previously known unit has a transparent sheet. By way of example, the front large area of said sheet is provided with a layer which is not light-transmissive and in which motifs, such as e.g. graphics, symbols, images or the like, may be embodied. In order to protect these motifs, the front side of the motif is covered with a protective layer made, for example, of a clear and hard resin. An electroluminescent apparatus or an EL lamp is assigned to that side of the sheet which is remote from the motif. Said EL lamp is provided with straps or lugs, of which one lug is connected to one of the electrodes of the EL lamp and the other lug is connected to the other electrode of the EL lamp. The EL lamp is supplied with electrical energy via said lugs or straps.

The front region of this previously known unit is of complicated construction owing to the need to use a plurality of layers. Moreover, it is often demanded that the display units have a non-planar form. This is because it is often demanded that the display shall have windows or depressions whose side areas shall likewise luminesce. For this purpose, the EL lamp has to be drawn from the front area of the display right into the region of the side walls thereof bounding said window or said depression. Inter alia owing to the layer construction which tends toward cracking in the previously known display, the latter can only be bent gently. The minimum achievable radius of a curved portion of the previously known display is in the region of about 6 mm. This is a radius that is too large for example in panel units in an automobile. The fitting of the abovementioned straps or lugs to the electrodes of the EL lamp is also problematic. This is because said electrodes are formed by very thin layers, while the straps or lugs are comparatively thick material strips in comparison with the electrode layers.

The object of the present invention is to eliminate these and also further disadvantages of the prior art.

In the case of the three-dimensional electroluminescent display of the generic type mentioned in the introduction, this object is achieved according to the invention in the manner defined in the characterizing part of patent claim 1.

Figures 1, 2:
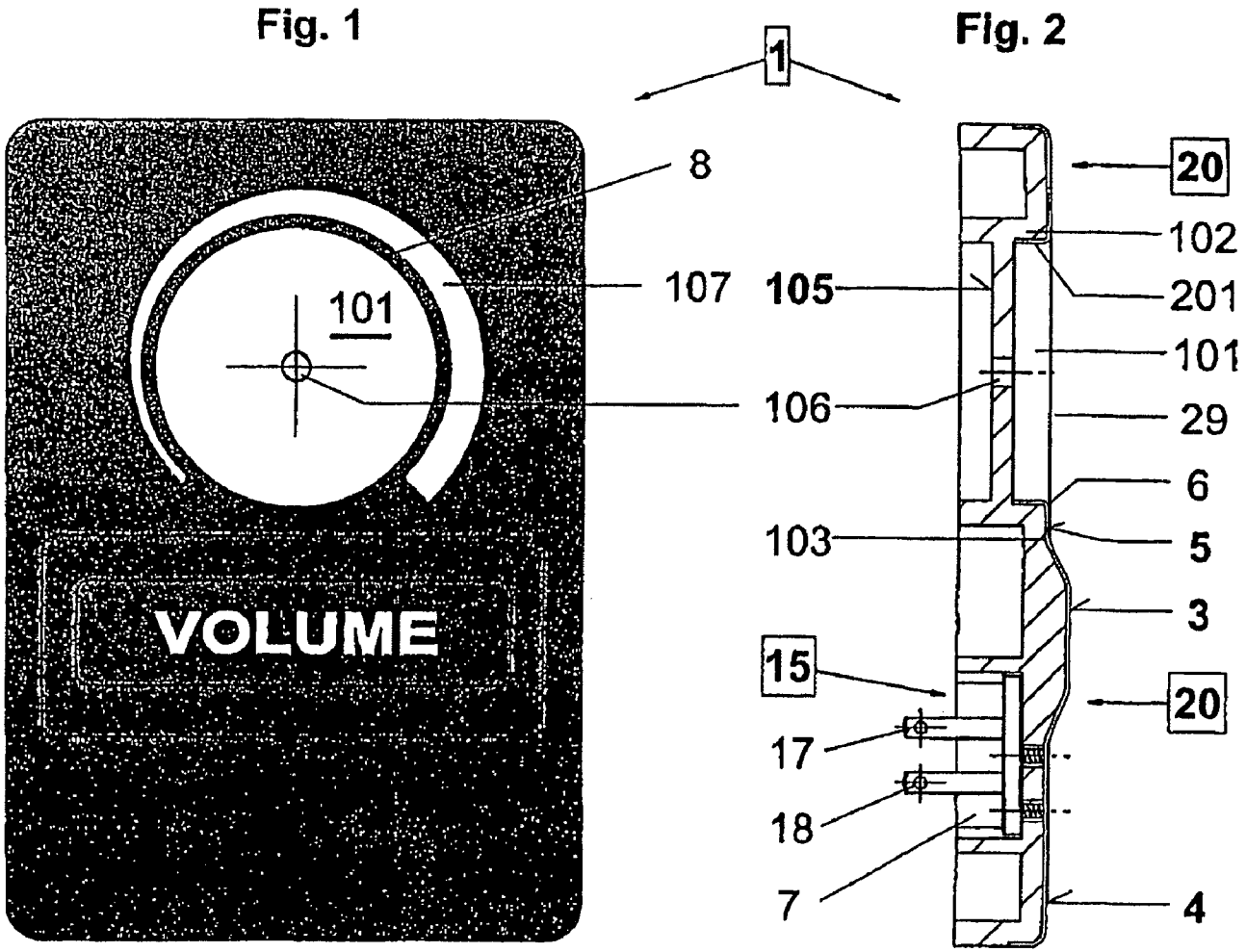
Figure 3:
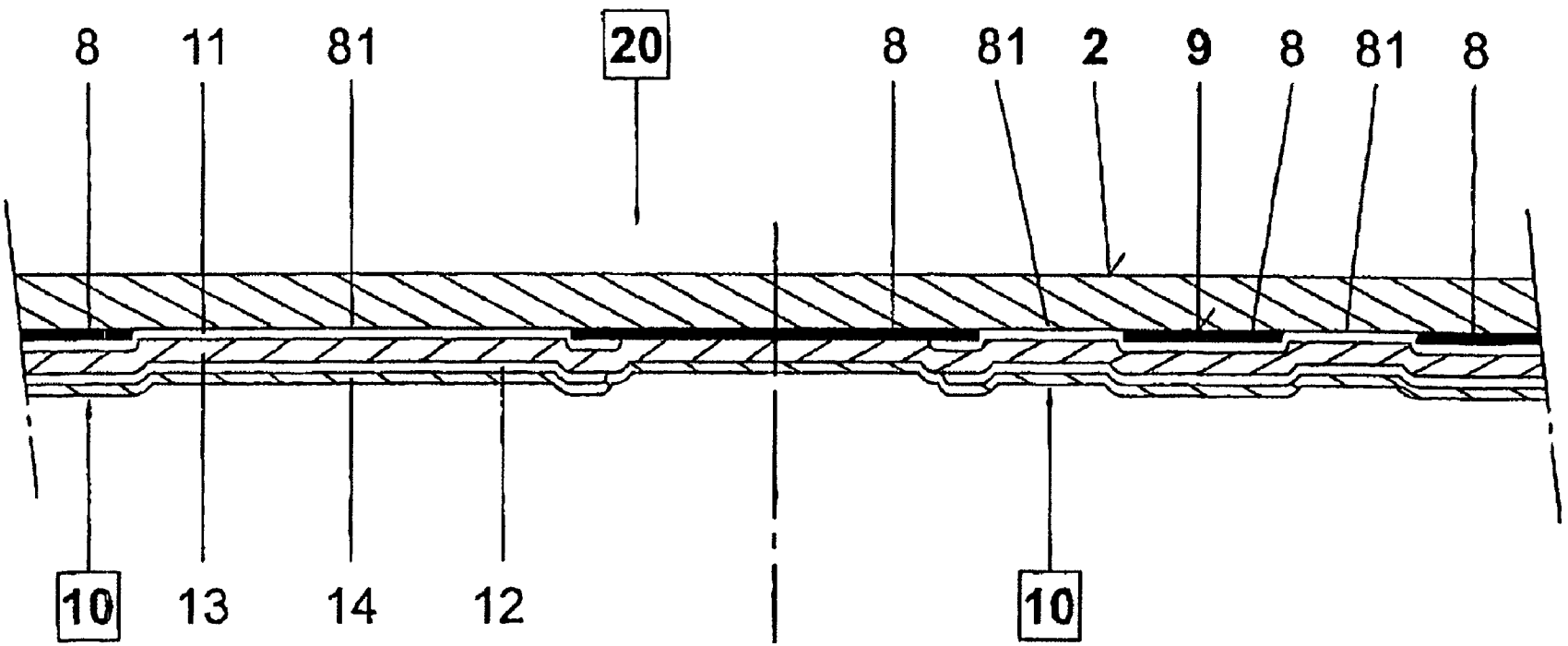
Figure 4:
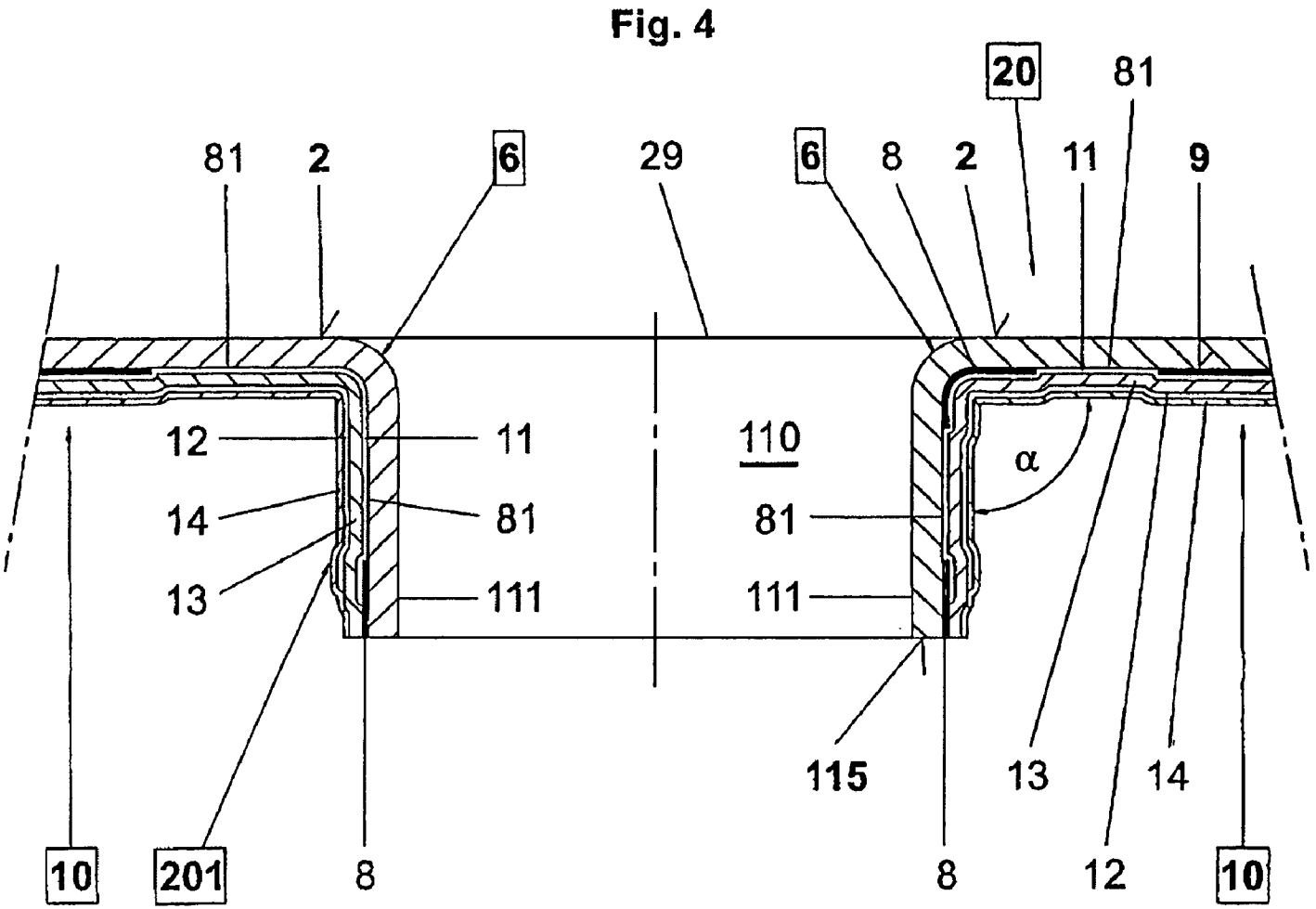
Figure 5:
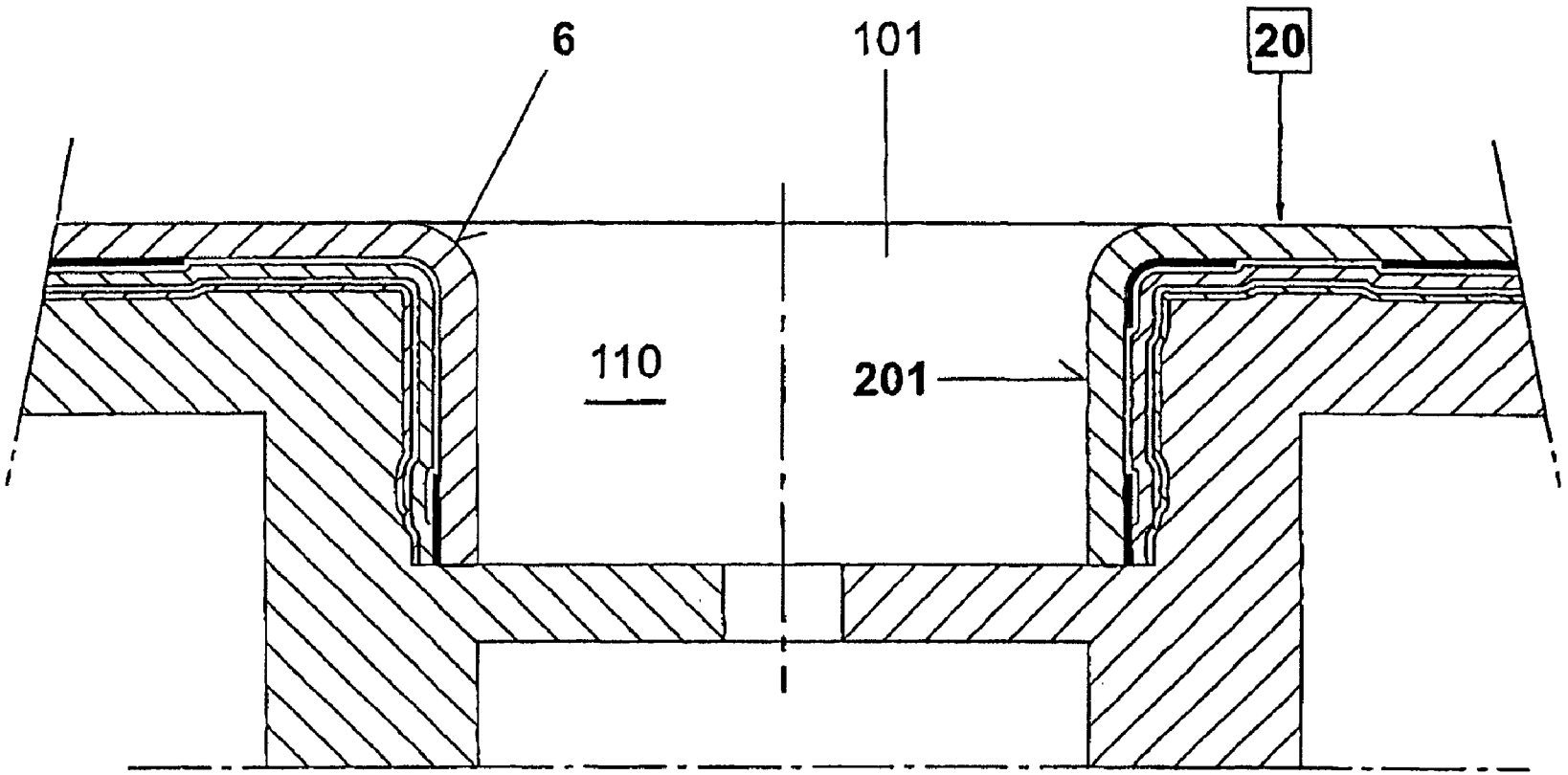
Figure 6:
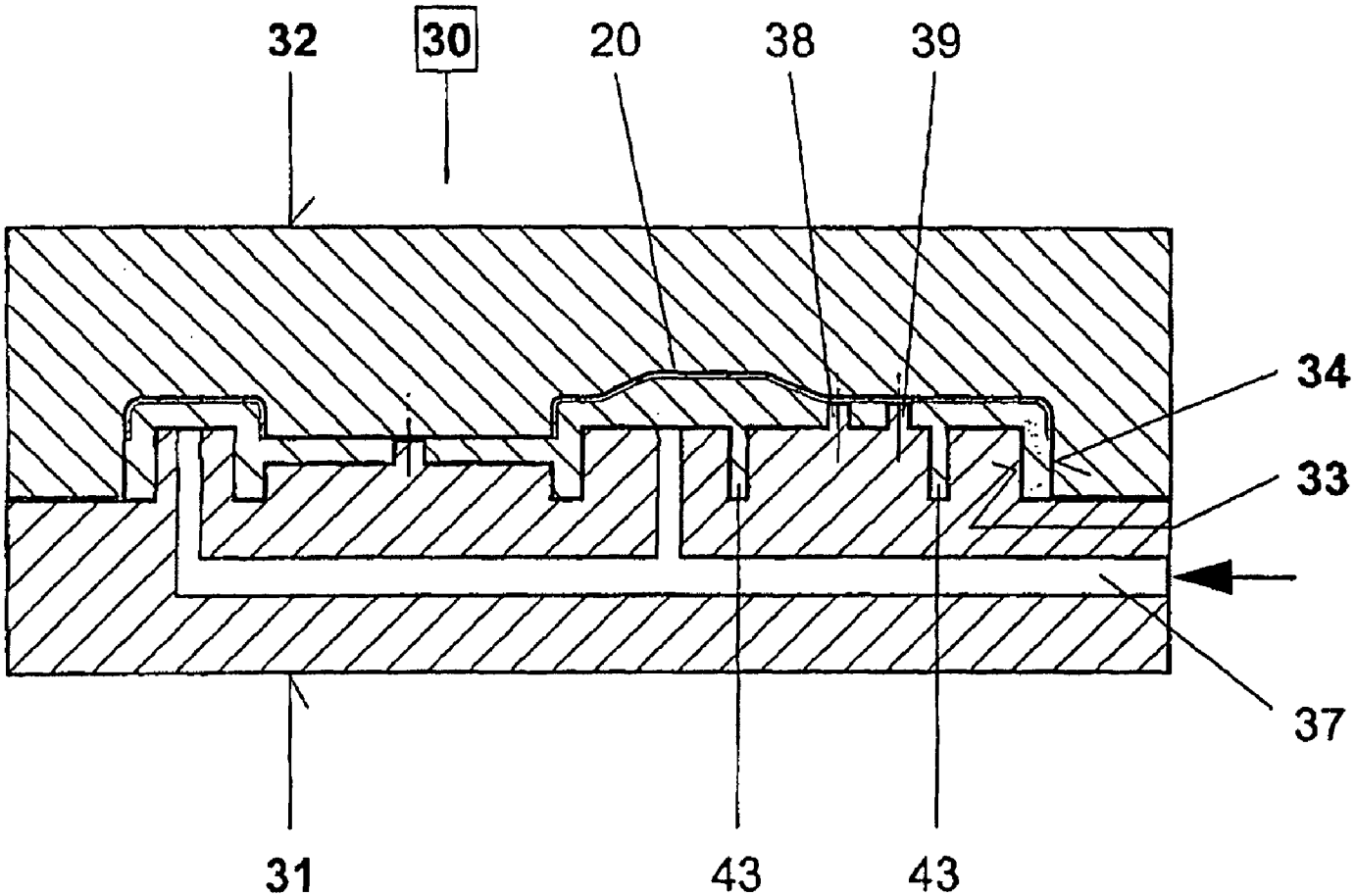
Figure 7:
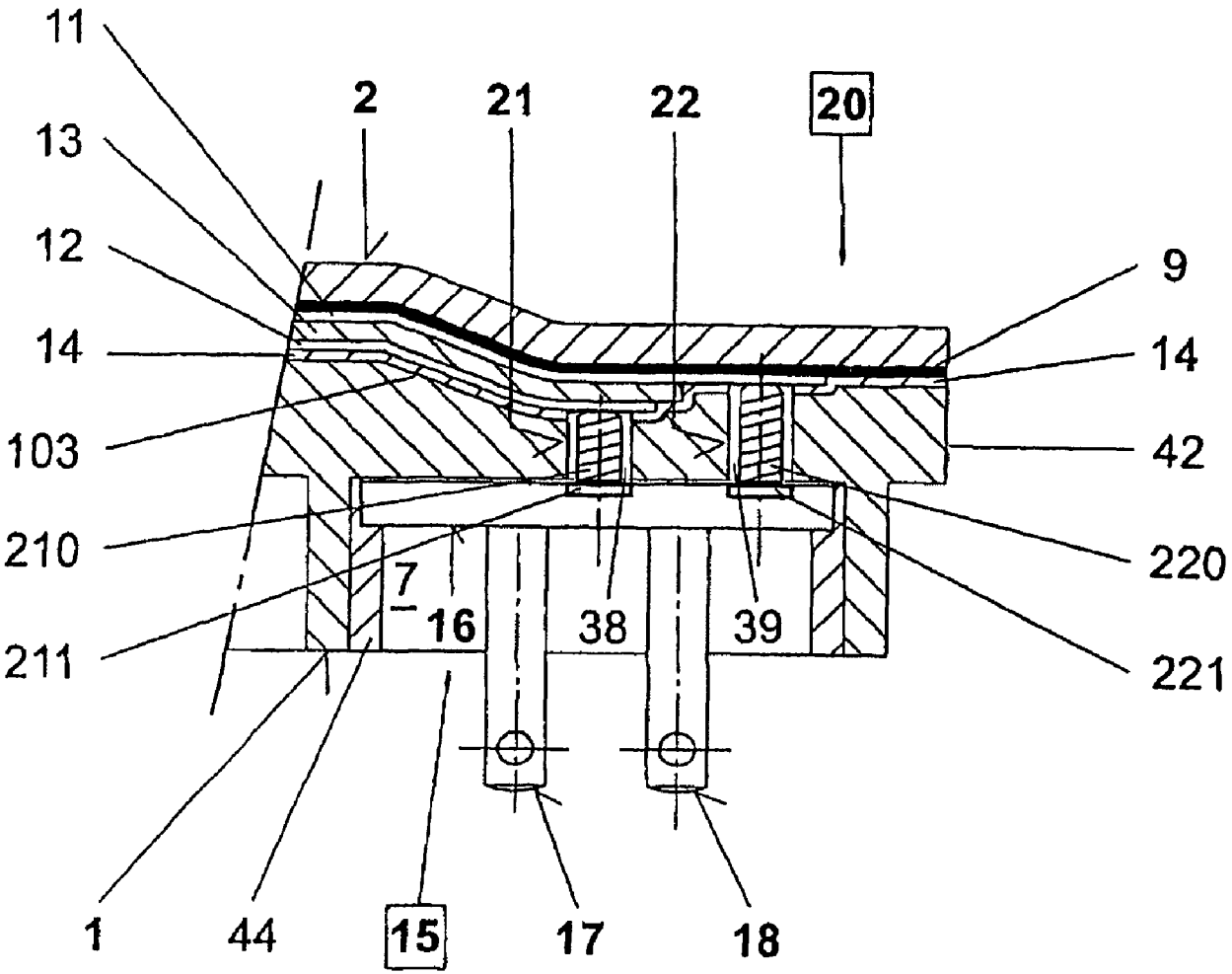
Figure 8:
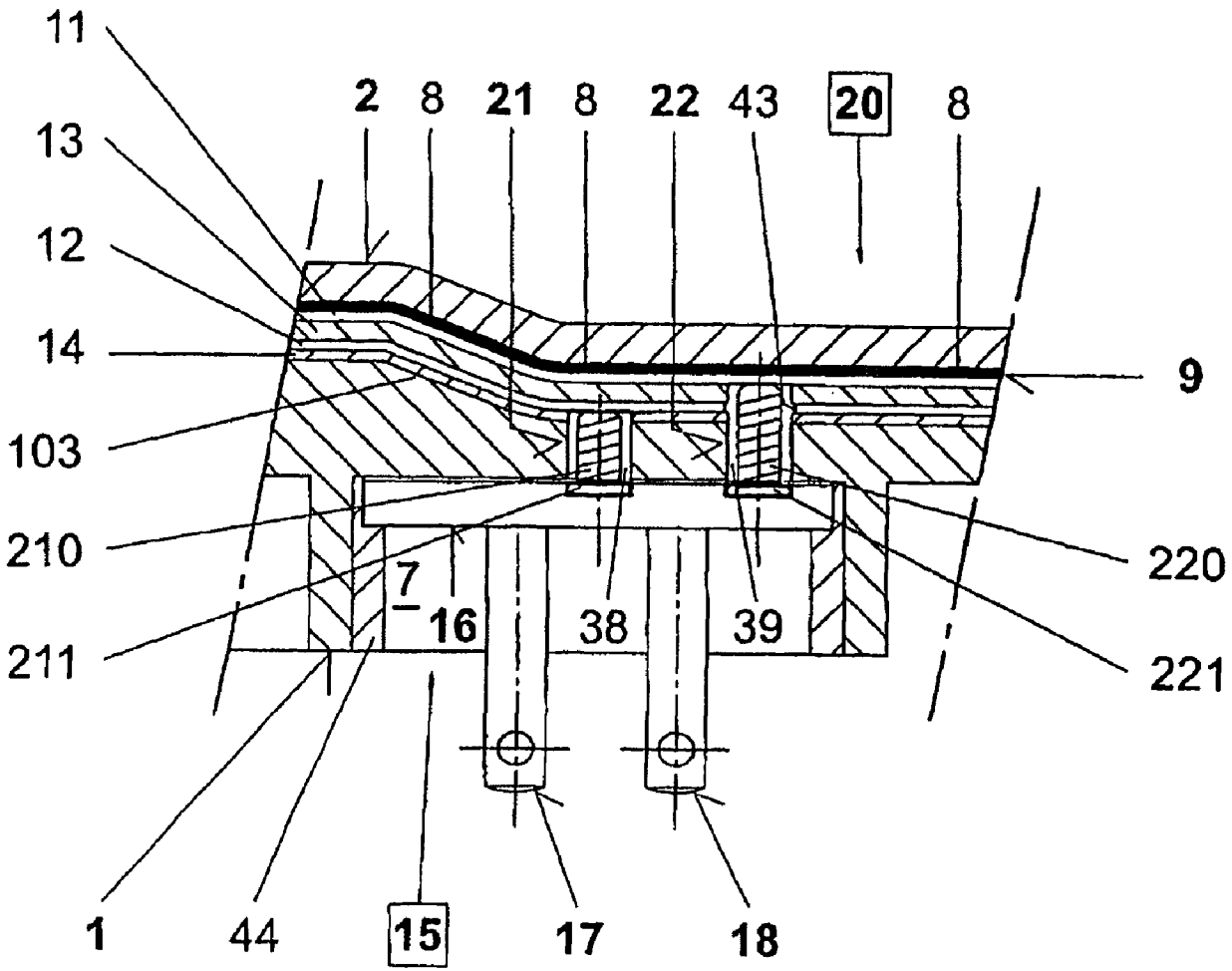
Figure 10:
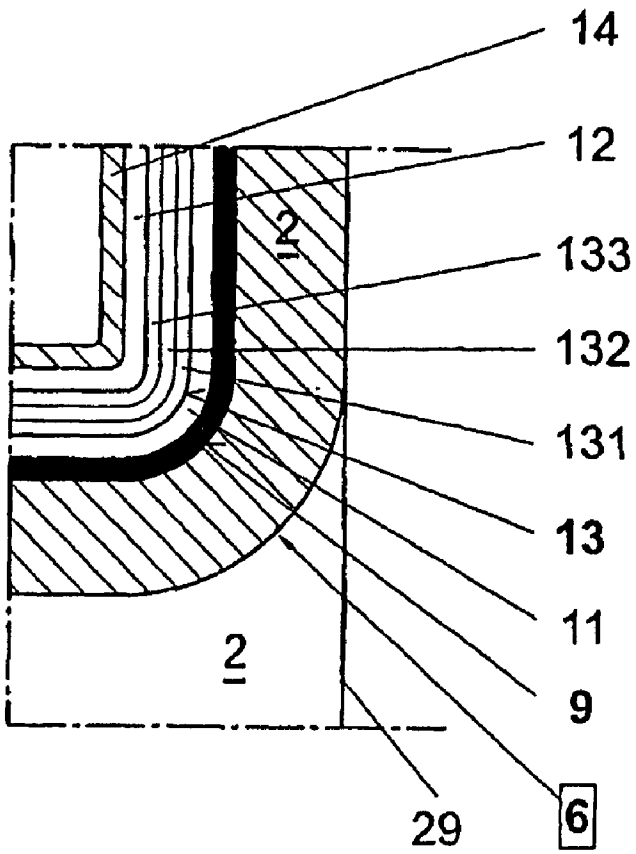
Figure 9:
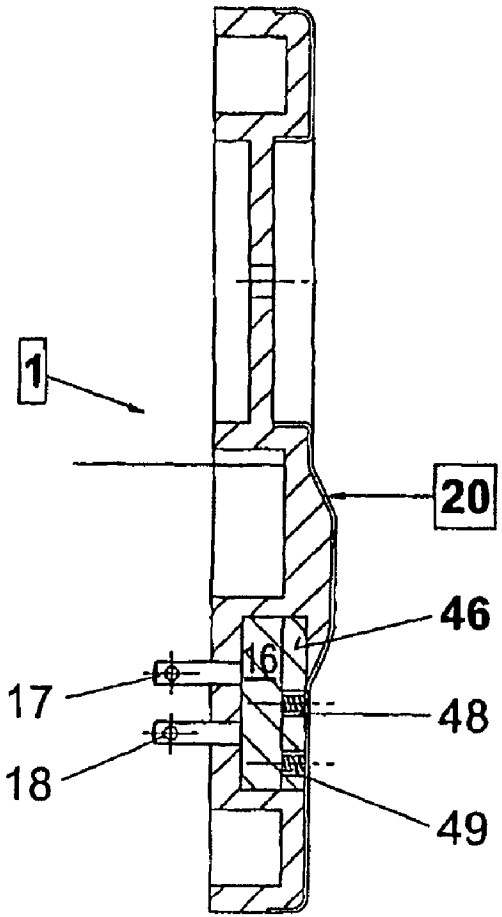

Embodiments of the present invention are explained in more detail below with reference to the accompanying drawings, in which:

FIG. 1 shows a plan view of the front side of one of the embodiments of the present three-dimensional electroluminescent display, FIG. 2 shows a vertical section through the structural part from FIG. 1, FIG. 3 shows a section through a detail from a semifinished product, the further processing of which leads to the display unit from FIG. 1, FIG. 4 shows a section through the semifinished product of FIG. 3 after said product has been subjected to a thermoforming treatment, FIG. 5 shows a section through the semifinished product of FIG. 4 after said product has had a suitable material injection-molded behind it, which constitutes the main body of the present display unit, FIG. 6 shows a section through a mold in which the main body in accordance with FIG. 5 can be produced, FIG. 7 shows a section through a detail from that region of the display unit in accordance with FIGS. 1 and 2 where contact points are situated, FIG. 8 shows a section through a detail from one of the edge regions of the display unit in accordance with FIGS. 1 and 2 where the contact points may likewise be situated, FIG. 9 shows a section through the accommodation of a supply source in the interior of the main body of the present display, and FIG. 10 shows a vertical section through a curved part of the present display.

FIG. 1 shows a plan view of the front side of one of the possible embodiments of the present three-dimensional electroluminescent display. This three-dimensional electroluminescent display is also called hereinafter for short. FIG. 2 shows a vertical section through the display unit from FIG. 1. The display unit has an essentially areal main body 1 provided with an electroluminescent device 20. This device 20 is essentially assigned to the front area 103 of the main body 1 and it can permit desired graphical representations such as images, numbers, etc. to appear to luminesce. Said main body 1 is made of a suitable plastic, it being advantageous if said plastic can be processed in an injection-molding process. A material from the group of acrylonitrile butadiene styrene terpolymers (ABS) may be involved, by way of example.

A depression 101 having a circular contour is embodied in the front side 103 of the main body 1 of the display unit illustrated. Said depression 101 has a circularly peripheral side wall 102, the inner area of which is practically at right angles to the main plane or to the front side 103 of the areal main body 1. The surface of this portion of the inner area 102 of the depression 101 adjoins the front area 103 of the main body 1. The peripheral side wall 102 thus projects downward and backward from the front wall 103 of the areal main body 1. FIG. 2 furthermore reveals that a portion 201 of the electroluminescent device 20 continues in the interior of the main body depression 101 and covers a part of the inner area of the wall 102 bounding the depression 101.

The depression 101 furthermore comprises a bottom 105, which, in the example illustrated, is situated approximately at half the height of the peripheral side wall 102 of the depression 101. An opening 106 is made in the center of said bottom 105, through which opening, by way of example, the spindle of a potentiometer (not illustrated) can pass. An actuating knob may be fitted to the protruding end of the spindle of the potentiometer. The widening track 107 (FIG. 1), which practically runs parallel to the depression wall 102, indicates the direction in which the controlled variable, for example volume, acquires its larger value.

A cavity 7 is made in a further region of the main body 1 of the unit, which cavity opens toward the rear or backward. Said cavity 7 may have a quadrangular contour. In this case, said cavity 7 is laterally bounded by four walls 43 projecting backward from the rear side of the areal portion 103 of the main body 1. The cavity 7 serves for receiving a source 15 for supplying the electroluminescent device 20 with electrical energy. The cavity 7 lies below said depression 101 in the case shown in FIG. 2. FIG. 2 also illustrates contact pins 17 and 18, via which a DC voltage of 12 volts, for example, is fed to the source 15. Said contact pins 17 and 18 are situated at that side of the source 15 which is remote from the electroluminescent device 20.

FIG. 3 shows a vertical section through the structure of the electroluminescent device 20, in which case FIG. 3 involves only a portion or detail from the device 20 which is illustrated in FIG. 2. The electroluminescent device 20 comprises a front transparent or at least translucent and areal part 2, which is illustrated at the very top in FIG. 3. The film 2 must furthermore have the property of being able to be thermoformed. Plastics which are suitable for producing such films 2 are generally known. By way of example, a film marketed under the trade mark Makrofol® by the company Bayer AG may be mentioned as representative of other materials of this type as well. In order to obtain particular effects, the film 2 may also be realized by means of multilayer construction.

The underside or rear side of the film 2 illustrated in FIG. 3 is provided with a two-dimensional motif 9. Said motif 9 may be, by way of example, three-dimensional graphical representations such as symbols, images, numbers, etc. The contents of such motifs 9 are defined by discrete elements 8 lying next to one another at intervals and intervening windows 81. Light which passes through the windows 81 between the motif elements 8 to the film 2 reproduces the content of the motif 9. In the sectional illustration of FIG. 3, the motif elements 8 appear as discrete lines provided on the back or rear side of the film 2. Consequently, these motifs 9 are situated in the interior of the electroluminescent device 20, where they are protected against abrasion and other adverse influences, for example, by the film 2 arranged in front of them.

The rear side of the film 2 and thus also the rear side of the motif 9 is assigned the actual luminescent apparatus 10, which is an electroluminescent apparatus in the case illustrated. This apparatus is also called just EL apparatus or EL lamp 10 hereinafter. The EL apparatus 10 has two areal electrodes, namely a front electrode 11 and a back electrode 12, which are situated at a distance from one another. A dielectric 13 is arranged between said electrodes 11 and 12. Said dielectric 13 is such that it can luminesce if the operating voltage is applied to the electrodes 11 and 12 of the EL apparatus 10. A covering layer 14 made of an insulating material is deposited at the rear side of the EL apparatus 10.

During the production of the present unit, firstly the electroluminescent device 20 is produced. In a first production step, the film 2 is provided. This means that the film 2 is initially present in its undeformed, i.e. practically planar form. Said film 2 subsequently serves as a carrier in the EL device 20, to be precise inter alia also as a carrier for the EL apparatus 10. The rear or back side of the film 2 is provided with one or more motifs 9, for example by printing. In a further production step, the first electrode, i.e. the front electrode 11, of the EL apparatus 10 is provided on the rear side of the motif 9 and on those regions of the rear side of the film 2 which are uncovered between the motif elements 8. This may likewise be done in a method known per se. When choosing this method, care must be taken to ensure that the front electrode 11 adheres on the film 2 as well as possible. Furthermore, the material of the front electrode 11 must be not only conductive but also transparent or at least translucent. The material of the front electrode 11 may be an inorganically or organically based electrically conductive material, e.g. Baytron® and/or polyaniline and/or polypyrrole, modified with highly flexible binders, e.g. based on PU, PMMA, PVA.

A further layer 13 is applied to said front electrode 11, said further layer comprising the dielectric material already mentioned. Said material may comprise for example a mixture of ZnS, $BaTiO_3$ and the highly flexible binders mentioned.

Finally, the third layer is deposited on the free, i.e. rear, surface of said dielectric layer 13, which said layer constitutes the back electrode 12. The material of said back electrode 12 may be an inorganically or organically based electrically conductive material, e.g. Baytron® and/or polyaniline and/or polypyrrole, modified with highly flexible binders, e.g. based on PU, PMMA, PVA. In order to improve the electrical conductivity, the material of said layer 12 may have silver or carbon added to it and/or be supplemented with a layer made of these materials.

Finally, the covering layer 14 is applied to the rear side of the EL apparatus 10.

Owing to the subsequent treatment of this electroluminescent device 20, it is extremely important that the individual layers of the electroluminescent apparatus 10 also adhere on one another as well as possible. The above-described composition of the individual layers 11 to 14 ensures not only the immovable adhesion of said layers on one another but also an expansibility of said layers that could not be achieved heretofore.

The electroluminescent device 20, in which the EL apparatus 10 adheres fixedly on the film 2, is now thermoformed, embossed, hollow-embossed, solid-embossed or the like (FIGS. 2 and 4). The electroluminescent device 20 which is formed in this way may also have, inter alia, elevations 3 and depressions 4 (FIG. 2). The thickness of these portions 3 and 4 of the EL device 20 is essentially the same as the thickness of the nondeformed portions 5 (FIG. 2) of the electroluminescent device 20.

During said deformation of the electroluminescent device 20, it is even possible to obtain perforations in the electroluminescent device 20 without this adversely affecting the functionality of the electroluminescent device 20. FIG. 4 shows one of the regions of the EL device 20 in a vertical section which has such a perforation 110. Said perforation 110 has a circular contour and said contour is adjoined by an extension 201 having the form of a short tubular piece. The wall 111 or the walls of said extension 201 are at a practically right angle $\alpha$ to the end face 29 of the electroluminescent device 20.

The extension 201 has been formed from that portion of the material of the EL device 20 which was situated within said circular contour of the perforation 110 and which was drawn into the perforation 110 by the thermoforming. A curved transition portion 6 (FIGS. 4 and 10) of the EL device 20 is situated between the extension 201 and the planar portion of the EL device 20 which surrounds the perforation 110. The radius of curvature of said transition portion 6, which extends from the end face 29 of the electroluminescent device 20 as far as the side area 111 of said extension 201, can be kept very small. By virtue inter alia of the immovable adhesion of the layers 2, 9 and 11 to 14 on one another and also owing to the expansibility of said layers 2, 9, and 11 to 14 which has not been able to be achieved heretofore, the radius of curvature of the transition portion 6 may be less than 1 mm without cracks arising in the layers of the EL device 20. Moreover the wall 111 of the extension 201 may be at an angle $\alpha$ of practically 90 degrees, i.e. practically perpendicular, to the end face 29 of the electroluminescent device 20.

The dielectric 13 constitutes a comparatively thick layer in comparison with the electrodes 11 and 12 of the EL device 20.

This dielectric layer 13 may comprise a plurality of layers lying one on top of the other. The relevant portion of the transition region 6 of the EL device 20 is shown greatly enlarged in FIG. 10.

The electroluminescent device 20 illustrated in FIG. 10 has a dielectric layer 13 comprising three layers 131, 132 and 133. Said layers 131, 132 and 133 may be made of one of the abovementioned dielectric materials or they may be made of different dielectric materials. During the production of the EL device 20, the layers 131, 132 and 133 are applied individually and successively to the front electrode 11 and to the respective layer applied previously.

The bottom edge 115 of the extension 201 is free. Owing to the extraordinary adhesion of the individual layers of the electroluminescent device 20 on one another, as already mentioned, and owing to the high expansibility thereof, the electroluminescent device 20 retains its original structure, or structure present in the region of the front area 103, in the thermoformed portion 201 as well. Consequently, the cylindrical inner area 111 of said extension 201 can also radiate the light generated by the electroluminescent apparatus 10.

In this embodiment of the present invention it is possible to configure the free end part 115 of the extension 201 in such a way that the electrodes 11 and 12 do not reach as far as the cut edge 115. Both the front electrode 11 and the back electrode 12 end at a distance from the cut edge 115. By contrast, both the covering layer 14 and the dielectric layer 13 reach right into the region of the cut edge 115. This also entails, inter alia, a safety-relevant advantage, namely that the electrodes 11 and 12, which are at a comparatively high electrical potential, cannot be touched because their free edges are covered at least by the insulating material of the covering layer 14. Moreover, the layers 13 and 14 reaching as far as the cut edge 115 prevent possible penetration of moisture into the spaces between the individual layers of the electroluminescent device 20.

After thermoforming, the main body 1 is assigned to the rear side of the electroluminescent device 20. This may be for example by a material suitable for this being injection-molded behind the electroluminescent device 20. Some of the materials suitable for this have already been mentioned above. FIG. 5 shows a vertical section through that detail from the unit in accordance with FIG. 2 in which the depression is situated, to be precise together with the relevant portion of the main body 1 in which the extension 201 in the form of a tubular piece is located. It is understood that the material of the main part 1 settles on the outer side of the extension 115 whilst being injection-molded behind.

FIG. 6 shows a mold 30, in which the unit shown in FIGS. 1 and 2 can be produced by injection-molding behind the electroluminescent device 20. Said mold 30 has a lower part 31 and an upper part 32, which match one another and which are guided such that, by way of example, they can be pivoted or they can be displaced rectilinearly with respect to one another in a manner known per se when said mold 30 is to be opened and closed. A first die insert 33 is situated in the lower part 31 of the mold and a second die insert 34 is situated in the upper part 32 of the mold. The course of the surface of the cavity in the respective die insert 33 or 34 corresponds to the course of the desired surface of that side of the display unit which is to be molded by the relevant die insert 33 or 34. Channels 37 are made in the lower part 31 of the mold, through which channels the material which is to pass into the cavity of the mold is introduced into the mold 30 and distributed therein.

The course of the surfaces of the film 2 has already been described in connection with FIG. 2. The course of the surface of the cavity in the upper die insert 34 must correspond to the course of the outer surface or the front area of the film 2. The same applies correspondingly to the form of the surface of the cavity in the lower die insert 33. Here attention should primarily be drawn to two projections 38 and 39 which are situated at a distance from one another and project from the surface of the cavity in the lower die insert 33. The height of said projections 38 and 39 is chosen in such a way that the end face of said projections 38 and 39 bear on the rear side of the EL device 20 during the process of injection-molding behind. As a result, two channels 38 and 39 remain free in this region of the main body 1, the use of said channels being described below.

The supply source 15 already mentioned includes an electronic part, namely a converter 16, which converts a comparatively low DC voltage of 12 V, for example, into a comparatively high AC voltage required for the operation of the EL apparatus 10. In the case illustrated, said converter 16 is incorporated in the cavity 7 of the main body 1 already mentioned and held in place with the aid of a clamping sleeve 44, for example. Otherwise, the converter 16 may be incorporated only partially in the main body 1 of the display unit or it may be present as a unit independent of the display unit.

The contact pins 17 and 18, likewise already mentioned, project from the rear side of the converter 16, and may partially project from the material of the main body 1. The poles of a DC voltage source, e.g. of an accumulator (not illustrated), may be connected to the portions of the pins 17 and 18 projecting from the main body 1. The voltage required for the operation of the electroluminescent device 20 may be 110 V/400 Hz and it is connected to the electroluminescent device 20 via contact apparatuses 21 and 22. (FIGS. 7, 8 and 9).

The first of said contact apparatuses 21 makes contact with the back electrode 12 of the EL lamp 10. The second of the contact apparatuses 22 makes contact with the front electrode 11 of the EL lamp 10. The first of said contact apparatuses 21 lies in the first channel 38 of the main part 1. The second of the contact apparatuses 22 lies in the second channel 39 of the main part 1. The respective contact apparatus 21 or 22 comprises a spring, a helical spring 210 or 220, respectively, in the case illustrated. The springs 210 and 220 bear at one end on a corresponding electrically conductive output point 211 and 221, respectively, of the converter 16. The other end of the spring 210 of the first contact apparatus 21 bears on the material of the back electrode 12 of the EL apparatus 10. The other end of the spring 220 of the second contact apparatus 22 bears on the material of the front electrode 11 of the EL apparatus 10.

The arrangement illustrated in FIG. 7 relates to the case, if the contact apparatuses 21 and 22 are assigned to a region of the EL lamp 10 of this, where the electrodes 11 and 12 of the EL lamp 10 do not lie above one another. This may be the case for example in an edge part 42 of the EL lamp 10, which is represented in FIG. 7. In said edge part 42, the marginal edge of the back electrode 12 is at a greater distance from the edge 42 of the EL lamp 10 than the marginal edge of the front electrode 11. Only the covering electrode 14 reaches as far as the edge 42 of the EL lamp 10, said electrode being made of an electrically insulating material.

If contact is to be made with the electrodes 11 and 12 of the EL lamp 10 by the supply source 15 in an inner region of the EL lamp 10 in which the electrodes 11 and 12 lie one above the other, then an opening 43 for the passage of that contact apparatus 22 which is to make contact with the front electrode 11 has to be made in the layer of the back electrode 12. The opening 43 in the back electrode 12 must be large enough that said contact apparatus 22 does not make contact with the back electrode 12. For this purpose, it normally suffices if the opening 43 in the back electrode 12 is large enough to prevent the spring 220 of the contact apparatus 22 for the front electrode 11 from making contact with the back electrode 12.

After the main part 1 of the display unit has been produced by injection-molding behind the electroluminescent device 20, the electroluminescent device 20 adheres on the main body 1. The supply source 15 mentioned is then inserted into the cavity 7 of the main body 1, to be precise in such a way that the contact apparatuses 21 and 22 lie in the channels 38 and 39 of the main body 1. The supply source 16 is then pressed into the cavity 7 until the front ends of the springs 210 and 220 bear on the conductive layer of the relevant electrode 12 and 13, respectively, of the electroluminescent apparatus 10. Afterward, the supply source 15 has to be fixed in this position, which may be done for example by means of a suitable adhesive or the like.

FIG. 8 shows a further possibility in respect of how the supply source 15 can be assigned to the main body 1. In this case, the substantial part of the supply source 15 is incorporated in the main body 1. In order to produce this arrangement, an areal adapter piece 46 is used. In said adapter piece 46, there are channels 48 and 49 extending perpendicular to the main areas of the adapter piece 46. One of the large areas of the adapter piece 46 is adhesively bonded on the covering layer 14 of the EL lamp 10. The supply source 15 is then assigned to the adapter piece 46 in such a way that the respective spring 38 or 39 of the supply source 15 passes through one of the channels 48 or 49, respectively, in such a way that its front end bears on the relevant electrode 11 or 12, respectively, of the EL lamp 10. The front side of the converter 16 is adhesively bonded onto the large area of the adapter piece 46 which is remote from the EL lamp 10. The semifinished product thus prepared may be inserted into the mold 30 and have the material of the main body 1 injection-molded behind it. In this case, the lower part 31 of the mold 30 is shaped such that the material of the main body 1 is also situated behind the converter 16, and that only portions of the pins 17 and 18 to which the DC voltage already mentioned can be applied project from said material of the main body 1.

The display unit comprises the main body 1 and the EL device 20. Said electroluminescent device 20 comprises the film 2 and the electroluminescent apparatus 10, which together form a whole. That area of the film 2 which faces the electroluminescent apparatus 10 is provided with motifs 9 to be displayed. The electroluminescent apparatus 10 comprises the front electrode 11 and the back electrode 12, between which the dielectric 13 is situated. The front electrode 11 is assigned to the layer that reproduces the motif 9, and is in one piece with said layer. The supply source 15, which makes contact with the electrodes 11 and 12 of the electroluminescent device 20, is arranged within the area of the electroluminescent device 20.

The invention claimed is:

1. A three-dimensional electroluminescent display comprising an electroluminescent device (20) having a plurality of layers and a transparent or translucent front part (2), and an electroluminescent apparatus (10) arranged behind the front part, characterized in that at least the layers of the electroluminescent device (20) are fixedly interconnected in such a way that these layers withstand a degree of curvature of the electroluminescent device (20) with a radius of curvature less than 1 mm without cracks arising in the layers of the electroluminescent device (20).

2. The display as claimed in claim 1, characterized in that the electroluminescent apparatus (10) comprises: a front areal electrode (11) and a back areal electrode (12), said electrodes being situated at a distance from one another, and a dielectric (13) situated between said electrodes (11, 12), wherein said dielectric is such that it can effect luminescence if a voltage is applied to the electrodes.

3. The display as claimed in claim 1, characterized in that the front part (2) is embodied as a film, in that motif (9) is applied on the back or rear large area of the film (2) to form a motif layer, and in that the front electrode (11) of the electroluminescent apparatus (10) is applied on the motif layer (9).

4. The display as claimed in claim 2, characterized in that an outer large area of the back electrode (12) of the electroluminescent apparatus (10) is provided with a covering layer (14).

5. The display as claimed in claim 1, characterized in that a main body (1) is assigned to an outer large area of the electroluminescent device (20).

6. The display as claimed in claim 5, characterized in that the main body (1) is provided with at least one depression, in that said depression has at least one side wall which is practically perpendicular to the front area of the main body (1), and in that the electroluminescent apparatus (10) assigned to the front wall of the main body (1) continues with a corresponding portion in the depression, and in that said portion of the electroluminescent apparatus (10) bears on the side wall of the depression.

7. The display as claimed in claim 1, characterized in that a converter (16) is provided, which can convert a DC voltage into an AC voltage, in that the output of said converter is connected to the electroluminescent apparatus (10), and in that the converter (16) may be incorporated at least partially in the material of the main body (1) of the display unit.

8. The display as claimed in claim 1, wherein one of said layers of said electroluminescent device is an electrode consisting of at least one of: PEDOT, polyaniline and polypyrrole.

9. A method for producing the display as claimed in claim 1, characterized in that an essentially planar film (2) is provided, in that one of the large areas of said film is provided with a motif (9), and in that the electroluminescent apparatus (10) is assigned to the film (2) in such a way that the front electrode (11) of said electroluminescent device (20) lies on that side of the film (2) which is provided with the motif (9).

10. The method as claimed in claim 9, characterized in that the electroluminescent device (20) is thermoformed.

11. The method as claimed in claim 10, characterized in that the thermoformed electroluminescent device (20) has a plastic injection-molded behind it.

* * * * *